United States Patent [19]

Gueret

[11] Patent Number: 4,597,501

[45] Date of Patent: Jul. 1, 1986

[54] BOTTLE AND CLOSURE HAVING ANGULAR POSITIONING MEANS

[75] Inventor: Jean-Louis H. Gueret, Paris, France

[73] Assignee: L'Oreal, Paris, France

[21] Appl. No.: 659,547

[22] Filed: Oct. 10, 1984

[30] Foreign Application Priority Data

Oct. 13, 1983 [FR] France ..... 83 16298
May 10, 1984 [FR] France ..... 84 07200

[51] Int. Cl.[4] ..... B65D 41/09
[52] U.S. Cl. ..... 215/330; 215/331
[58] Field of Search ..... 215/330, 331

[56] References Cited

U.S. PATENT DOCUMENTS

| | | | |
|---|---|---|---|
| 3,295,708 | 1/1967 | Wathen | 215/330 |
| 3,435,978 | 4/1969 | Wittwer | 215/330 X |
| 3,581,926 | 6/1971 | Roder | 215/330 |
| 4,093,096 | 6/1978 | Augros | 215/330 |
| 4,230,232 | 10/1980 | Atkins | 215/330 |
| 4,280,632 | 7/1981 | Yuhara | 215/331 |
| 4,289,248 | 9/1981 | Lynn | 215/330 |
| 4,310,101 | 1/1982 | Sekine | 215/330 |
| 4,387,821 | 6/1983 | Geiger | 215/330 |
| 4,387,822 | 6/1983 | Lynn | 215/330 |

FOREIGN PATENT DOCUMENTS

| | | |
|---|---|---|
| 1471129 | 1/1967 | France . |
| 2036272 | 12/1970 | France . |
| 2044010 | 2/1971 | France . |

*Primary Examiner*—Donald F. Norton
*Attorney, Agent, or Firm*—Cushman, Darby & Cushman

[57] ABSTRACT

A bottle is closed by a stoppering device comprising either an integral stoppering and presentation cap or a stoppering cap on which a presentation cap is mounted, and means are provided for defining a precise angular positioning of the presentation cap in relation to the neck of the bottle, in the fully screwed down position. These precise angular position defining means comprise interengaging formations of the neck and of the stoppering device, positioned near the free end of the neck and near the top wall of the stoppering device which closes the neck.

6 Claims, 17 Drawing Figures

BOTTLE AND CLOSURE HAVING ANGULAR POSITIONING MEANS

FIELD OF THE INVENTION

The present invention relates to a bottle generally made of glass or of a plastic material, comprising a detachable stoppering device, generally made of a plastic material and being fitted by screwing on the neck of the said bottle, provision being made for elements to ensure a specific angular positioning of the stoppering device in relation to the bottle. Provision may, moreover, be advantageously made for "pilfer-proofing" elements intended to impede unscrewing of the stoppering device once it has been screwed down.

PRIOR ART

From Patent FR No. 2036 272, there is known a bottle of this kind wherein the stoppering device is formed by a cap fitting comprising on the one hand an internal thread system capable of cooperating with the external thread system of the bottle and, on the other hand, at least one radially inwardly projecting pin intended to cooperate with a notch of the neck. The presence of the internal thread system and of the radially inwardly projecting pin on the cap complicates the manufacturing operations of the cap, in particular the operation of stripping the cap from the mould; the radial pin resisting withdrawal from the mould by unscrewing, requires a mould of at least two parts. Moreover, to ensure a satisfactory mechanical stop action, the pin and hence the cap must be relatively rigid. Since the cap must, moreover ensure the seal, this rigidity, necessary for mechanical reasons, does not promote the seal.

The object of the invention is to overcome these drawbacks in particular.

Moreover, from the French Patent Application No. 2,514,327 in the name of the applicant company, a bottle is known which is made in particular of glass and which is fitted with a stoppering cap fitted by screwing on the neck of the bottle and for which one obtains, in the course of screwing, a specific angular positioning of the cap in relation to the bottle by causing the end of the cap thread situated at the start of the said thread, to bear against a stop provided in relief on the neck of the bottle. This cap, made of a relatively rigid plastics material, may have the external shape desired and, because on completion of the screwing action it occupies a predetermined angular position, it may form with the body of the bottle an assembly which can then have any desired aesthetic shape.

The fact of making provision for a relief in glass below the thread system of the neck of the bottle renders the manufacture of the bottle neck more difficult. It has therefore been considered necessary to simplify this manufacture to facilitate mass production.

Moreover, with this known stoppering device the angular positioning of the cap in relation to the bottle remains substantially constant in time, since it is obtained by causing one end of the thread of the cap, i.e. of an element made of a rigid material, to bear against a stop constituted by a relief in glass, also an element of a hard material. However, the fact remains that although the angular positioning is always accurately ensured, the quality of the screwing action is very mediocre and the seal of the stoppering is practically zero. In these conditions, one is obliged to use gaskets of an expanded polyethylene type, or card-board wad gaskets, which are disposed on the top wall of the cap; however, these seals lose their elastic quality with time, which produces a very haphazard seal.

It is known that, with a bottle made of glass or of a relatively rigid plastic material such as polyvinyl chloride (PVC), in order to obtain a completely leakproof stoppering—which is particularly desirable when the liquid contained in the bottle in volatile or contains volatile constituents such as perfumes—it is necessary to use a pliable or semi-pliable thermoplastic material such as low density polyethylene (LDPE), high density polyethylene (HDPE), or polypropylene for the stoppering cap.

The solution to the problem may therefore be to replace the above mentioned rigid stoppering cap by a stoppering device formed, on the one hand, by an inner cap of a pliable or semi-pliable material fixed on the neck of the bottle and, on the other hand, an outer cap made of a rigid or semi-rigid material, fitted on the inner cap at a predetermined angular position in relation to it. Unfortunately if, in order to obtain a good seal, the inner cap is a stoppering cap of a pliable or semi-pliable material—which ensures at the same time a good quality for the screwing action because of the elasticity of the said material—angular positioning of the stoppering device in relation to the bottle as accurate as that obtained with a hard cap (made for instance, of polystyrene, of terephthalate polybutylene (PBT), of polypropylene, or of a thermo-setting resin similar to Bakelite (R.T.M.) and sold under the designation of "POLOPAS") cannot be obtained. In fact, the end of the thread of the pliable or semi-pliable thermoplastic cap, which has to bear simply against the glass stop disposed on the bottle neck, is crushed against the said stop and after a certain number of screwing and unscrewing operations by the user the stoppering device will, on completion of the screwing operation, be displaced angularly in relation to the position which it should occupy at that instant. This defective angular positioning is precisely what it is hoped to avoid in the case where the outer cap has an external skirt surface which is non-cylindrical.

Moreover, it is known that for pilfer-proofing, i.e. in order to prevent an untimely unscrewing of a stoppering cap, provision is made below the thread of the bottle for a glass boss which is received in a recess of the cap or behind a boss of the cap. In accordance with the above mentioned French patent application No. 2514327 provision is made for preventing unscrewing of the cap by interrupting at least one thread of the cap at the level of its start so as to form two sections, one of shorter length, the other of greater length, separated by an interrupted zone, the shorter length section constituting a catch intended to be crossed by the associated stop of the neck by elastic deformation of the cap wall so that the above mentioned stop comes to be accommodated in the interrupted zone; the end of the long length section which is adjacent to the above mentioned catch ending in a radial wall cooperating with the associated stop of the neck so as to stop the screwing motion of the cap.

In all the cases of stoppering devices wherein provision is made for pilfer-proofing the recess or the boss of the cap is therefore always below the thread so that on manufacture, once the cap has been moulded, it cannot be removed from the mould by unscrewing because the boss or the edge of the recess forms an obstacle. Provision must therefore be made for the mould to comprise a two part core whereof one part is removed by translation in the zone of the boss or of the recess, whilst the other is withdrawn by rotation in the zone of the thread system.

In these conditions, it is necessary to use either a complex mould which slows down the rate of moulding or the cap must be stripped from the demould by pulling it out, which does not make it possible to obtain stoppering caps of accurate dimensions corresponding to a good production quality.

OBJECTS OF THE INVENTION

The present invention aims to overcome the first drawback referred to, by making provision for forming in the bottle neck, above its threaded zone, at least one stop against which on completion of the screwing action an associated protuberance of the stoppering device comes to bear. The disposition of this stop in the high part of the neck makes the manufacture of the neck much easier as may be seen by examining the various embodiments provided for in the present invention.

SUMMARY OF THE INVENTION

The present invention also overcomes the second drawback referred to because, if desired, it is possible to obtain simultaneously (a) the precise angular positioning of the stoppering device in relation to the bottle to be expected when using a cap of a rigid or semi-rigid material, and (b) the good screwing and sealing properties associated with the use of a cap made of a pliable or semi-pliable material. For this purpose, one embodiment uses a stoppering device constituted by an inner stoppering cap of a pliable or semi-pliable material and by an outer presentation cap of a rigid or semi-rigid material and provision is made in the top part of the cap for slots which are caused to be traversed by fins which are integral with the outer cap. On the one hand, this fixes the position of the outer cap in relation to the inner cap and, on the other hand, it allows the fins to be used for positioning the stoppering device in relation to glass stops provided on the upper part of the bottle neck. In another mode of embodiment of the invention wherein the stoppering device is also constituted by an inner cap of a pliable or semi-pliable material and an outer presentation cap of a rigid or semi-rigid material, provision is made for the outer cap to be positioned in relation to the inner cap by conventional fitting means of the slot/rib type, and the protuberances intended to cooperate with the stops of the neck inside the cap on completion of the screwing action are disposed against the end wall of the cap at the periphery or near the periphery of the said end wall.

In that latter case, it is advantageous to make provision for an arrangement according to which each protuberance provided within the cap should have the form of a thread element with the same pitch as the thread system of the said cap. In these conditions, the removal of the cap from the mould can, in fact, be effected by the simple unscrewing of the inner core having served for the moulding of the cap.

The present invention also enables the third drawback referred to to be remedied. Thus in the embodiment firstly mentioned above, it is in fact sufficient to make provision on the bottle neck for bosses which will be crossed by the fins on completion of the screwing action. These bosses are thus disposed at the upper part of the neck of the bottle above its threaded zone. The recesses which are provided in the cap for the passing of the fins are obtained in a very simple manner, at the time of moulding, by slides of the mould which are moved parallel in relation to the cap axis. The moulding of the stoppering cap is easy and allows stripping from the mould by unscrewing. The formation of the boss or bosses on the glass bottle neck does not, for its part, present any difficulty.

In the embodiment mentioned secondly above it has been seen that it could be easily arranged for the cap to be stripped from the mould by simply unscrewing the core. To obtain a restraint against unscrewing, it will be sufficient to form in the protuberance of the cap, a small cut-out intended to be accommodated on completion of the screwing action, in a glass boss formed near the stop of the neck. In stripping the cap from the mould it will suffice to use slight force for the core to be capable of detachment from the cap.

In accordance with the invention, provision can, of course, be made for the stoppering device to be constituted solely by a moulded outer cap carrying, on the one hand, the internal thread system intended to cooperate with that of the neck and on the other hand, the positioning protuberances, it being possible to remove this cap from the mould advantageously by a simple un-screwing action in relation to the mould core. The seal will be advantageously obtained by means of a gasket of a pliable material force fitted into the top end of the axial cut-out of the said cap, this gasket projecting so as to be capable of correctly ensuring a seal with the neck.

The present invention therefore provides a bottle comprising a detachable stoppering device carrying an internal thread system cooperating with a corresponding external thread system of the neck of the bottle, a predetermined angular positioning of the stoppering device in relation to the bottle being ensured by, firstly, at least one stop carried externally by the neck above the threaded zone of the said neck and, secondly, at least one protuberance carried internally by the stoppering device, the or each said protuberance being positioned and dimensioned so that when the stoppering device has been screwed down, each protuberance comes to bear against a respective stop of the neck.

According to one particular embodiment of the present invention, the stops of the neck are substantially radial.

In accordance with a particularly advantageous embodiment of the invention, the number of the protuberances of the stoppering device is equal to the number of stops of the neck, this number being more advantageously equal to the number of threads of the thread system carried by the neck.

The following three cases may be envisaged:

(1) If the stoppering device is constituted by (a) a stoppering cap and (b) a presentation cap fitted on the said cap and at least partly covering it, the stoppering cap being constituted by a cylindrical skirt joined to a top, and the said skirt carrying the internal thread system cooperating with the corresponding external thread system of the neck, provision may be made for the or each protuberance to be carried by the cover cap and to have the shape of a fin which is engaged in a slot cut in the wall of the cap near the periphery of its top. The number of slots cut in the cap may, in particular, be equal to the number of fins of the presentation cap. In accordance with a particular embodiment, the slots of the cap are cut into its top. Advantageously, the fins are substantially flat and perpendicular to the top of the presentation cap, their plane passing substantially through its axis. Moreover, each fin is advantageously carried by the top of the cap.

(2) If the stoppering device is constituted by a presentation cap whose axial cut-out is bounded by a lateral cylindrical wall and by a top, the said lateral wall carrying the internal thread system cooperating with the external thread system carried by the neck, provision is in particular made in accordance with the invention for the or each protuberance to be carried by the presentation cap against its top at or near the periphery of said top.

(3) If the stoppering device is constituted, as in the first case, by a stoppering cap and an outer presentation cap fitted on it and at least partly covering it, the said stoppering cap being constituted by a cylindrical skirt joined to a top, the said skirt carrying the internal thread system to cooperate with the corresponding external thread system of the neck and means being provided for ensuring the angular positioning of the presentation cap in relation to the cap, provision may be made for the or each protuberance to be carried by the stoppering cap against the top of the said cap at or near the periphery of the said top.

In accordance with the invention the stop of the neck, against which on completion of the screwing action a protuberance associated with the presentation cap comes to bear, may be constituted by the frontal starting face of a thread of the neck. In the case where the protuberances of the stoppering cap are fins of the presentation cap passing through the cap in the fitted position of the stoppering device on the bottle, the inner edge of each fin in relation to the bottle axis is advantageously comprised between the cylindrical surfaces corresponding respectively to the root and crest of the cap thread system.

The stop of the neck against which on completion of the screwing action a protuberance associated with the stoppering device comes to bear, may be constituted by a step formed on the upper edge of the neck, said step being formed by a limiting side of a cut-out on the said edge, the said cut-out being shaped so as to permit the protuberance to pass on completion of the screwing action, until it comes to bear against the said step. Advantageously the cut-out on the upper edge of the neck may comprise a lower side in the shape of a helical ramp having the same pitch as the thread system carried by the neck.

The stop of the neck against which a protuberance associated with the stoppering device comes to bear on completion of the screwing action may be constituted by one of the lateral walls of a rib carried by a constricted zone of the upper edge of the neck, the thread system being carried by the outer side of the rib, or of each of the ribs which is furthest removed from the constricted zone but does not project from the cylindrical wall of the neck.

In cases (2) and (3) described above, advantageously each protuberance may have the shape of a thread element which has the same pitch as the thread system of the element of the stoppering device (the inner cap or a presentation cap) whic carries it, and which terminates against the top end of the said element of the stoppering device.

When the loosening of the screwed down stoppering device is to be prevented, the means used for this purpose comprise at least one boss carried externally by the neck of the bottle, each such boss being intended to be crossed by a protuberance on completion of the screwing action before the protuberance bears against the associated stop of the neck.

In the case where by way of the protuberances the stoppering device carries fins of the cover cap passing through slots of the stoppering cap, the distance measured radially between the adjacent edges of one stop of the neck and of the boss associated with the said stop, is at least equal to the radial dimension of the fin constituting the protuberance intended to bear against the said stop on completion of the screwing action.

In the case where the stop of the neck is constituted by the frontal starting face of a thread of the said neck, the or each boss is advantageously carried by the peripheral wall of the neck. Each boss may then be constituted by a thread section situated in the extension of the thread with which it is associated and separated from the latter by an interrupted zone serving as accommodation for the associated fin on completion of the screwing action.

In the case where one stop of the neck is constituted by a step formed by a limiting side of a cut-out on the upper edge of the neck, the or each boss is carried by the upper edge of the neck and is disposed on the inner side of the above mentioned corresponding cut-out.

If the protuberances of the stoppering device are not constituted by fins, advantageously each protuberance may have a recess intended to contain the boss associated with the stop of the neck, on completion of the screwing action.

The seal between the stoppering device and the neck of the bottle is advantageously effected as follows: in the case where the stoppering device is constituted by a outer presentation cap and by an inner cap, the inner cap carries internally an axial inlet intended to be force-fitted within the discharge opening of the bottle, or the top panel of the cap has a central concave hemispherical zone intended to ensure the desired leakproof stoppering; in the case where the stoppering device is constituted solely by a presentation cap, the stopper comprises in its top end, a cut-out in which a hemispherical gasket is force-fitted.

In the case where the protuberances are constituted by fins, the inner cap and the presentation cap are joined by catch-engagement means, the relative positioning of these two elements being achieved by the cooperation between the fins of the presentation cap and the slots of the inner cap.

In the case where the stoppering device is constituted by a presentation cap and by an inner cap, the protuberances not being constituted by fins, the means provided for ensuring the angular positioning of the presentation cap in relation to the cap advantageously comprise at least one rib provided externally in relief on the inner cap parallel to the axis of the inner cap, and at least one groove arranged in the internal wall of the presentation cap, the or each said rib and the or each said groove being dimensioned and positioned in such a way that each rib should be force-fitted in a corresponding groove when the said presentation cap is moved translationally to surmount the inner cap.

According to one embodiment with a simplified structure, each stop of the neck may be constituted by the starting frontal face of a thread of the neck, and the associated protuberance may be constituted by an end face of one groove of the internal thread system of the stoppering device which allows the position of the stoppering device to be indexed on that of the bottle by the appropriate angular positioning of each end face of a groove of the internal thread system of the stoppering device, taking into account the angular position occupied on the bottle by the starting frontal face of a thread of the neck which constitutes the corresponding stop.

By integrating the stop or stops carried externally by the neck on the external thread system of the neck and the protuberance or protuberances carried internally by the stoppering device on the internal thread system of this stoppering device, the manufacture of the bottle is undoubtedly simplified to a considerable extent at the neck region, as is the manufacture of the stoppering device. In fact, as far as the bottle is concerned, it is unnecessary to arrange cut-outs in the shape of helical lamps in the upper edge of the neck, or to form projecting ribs on an upper conical part of the neck. As regards the stoppering device, it can be constituted by the association of an inner stoppering cap and of a presentation cap covering the inner cap without it being necessary either to form fins in the presentation cap and to arrange slots in the inner cap or to arrange helical lamps on the periphery of the top of the inner cap.

It is also possible for the stoppering device to constitute a stoppering presentation cap, and in this case too, it is not necessary to form helical ramps on the periphery of the top end of a presentation cap.

In order to prevent angular play in the positioning of the stoppering device in relation to the bottle, by reason of the deformation or crushing of the associated stop surfaces constituted by the starting frontal face of a thread of the neck and by the end face of a corresponding groove of the internal thread system of the stoppering device, these stop surfaces advantageously have the same inclination in relation to the radial direction so as to ensure, on completion of the screwing action, a good bearing contact of these surfaces on each other.

Moreover in order, on the one hand, to guarantee an optimum distribution of the compressive stresses and on the other hand to facilitate the construction of the moulds and the stripping of the element of the stoppering device which has the internal thread system from the mould by unscrewing, it is also advantageous for the corresponding starting frontal faces of one thread of the neck and of the end of one groove of the internal thread system of the stoppering device to be substantially radial faces.

BRIEF DESCRIPTION OF THE DRAWINGS

In order that the present invention may more readily be understood there will be described below six embodiments, represented in the accompanying drawings purely by way of illustrative and non-restrictive examples. In these drawings.

DESCRIPTION OF THE PREFERRED EMBODIMENTS OF THE INVENTION

Figure 1:
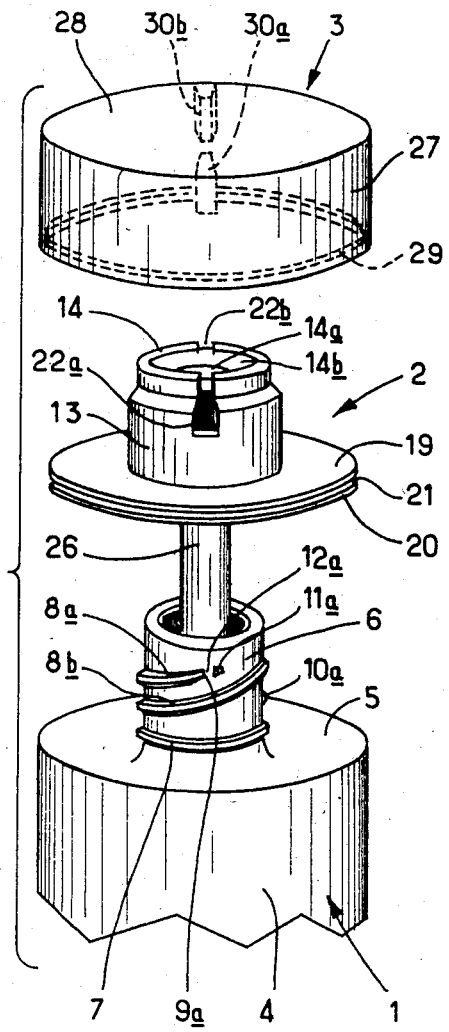
FIG. 1 is an exploded perspective view of the upper part of a bottle and of its stoppering device, in accordance with a first embodiment of the invention.
Figure 2:
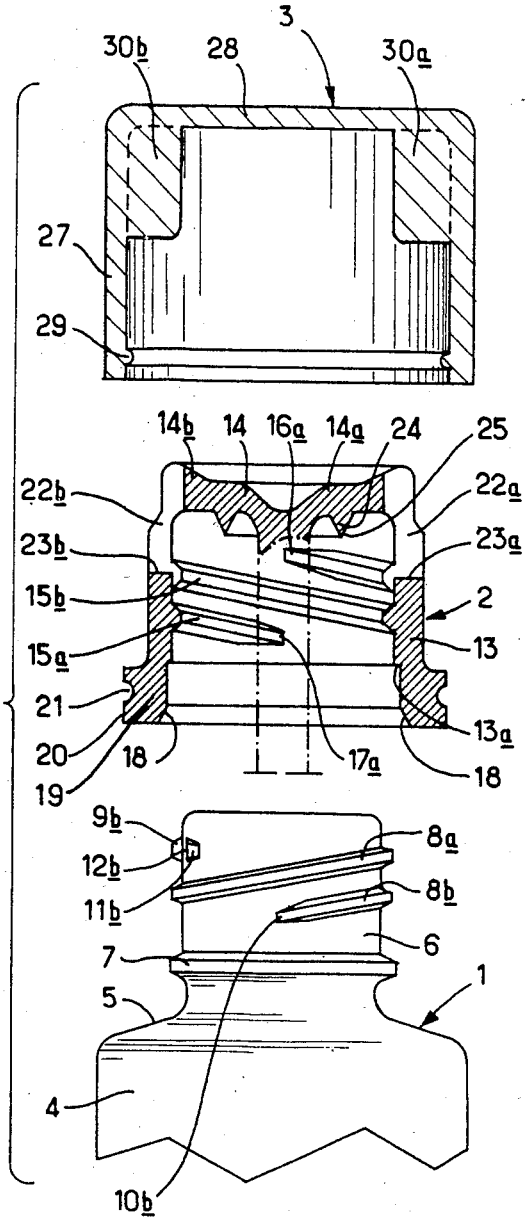
FIG. 2 is a view similar to FIG. 1 on an enlarged scale, subject to the difference that the upper part of the bottle viewed in elevation and the stoppering cap and the presentation cap composing the above mentioned stoppering device viewed in an axial cross-section are represented in positions which are displaced by a rotation of 90° about their respective axes, from the positions of these elements in FIG. 1.

Referring to FIGS. 1 to 4, it will be seen that 1 designates a glass or PVC bottle of small capacity, intended to contain, for instance, a cosmetic substance of a pasty consistency. Bottle 1 is associated with a stoppering device composed by an inner cap 2 and a outer presentation cap 3.

Bottle 1 has a body 4 of a substantially elliptical cross-section whose upper end 5 is joined to a central cylindrical neck 6 on the base of which is a peripheral ring 7 with a substantially trapezoidal cross-section. Above the ring 7 a thread system is formed of two threads 8*a*, 8*b*, each with a substantially trapezoidal cross-section.

The length of each one of the two threads 8*a*, 8*b* is approximately equal to three quarters of a turn. The ends of the two threads 8*a*, 8*b*, situated at the starts are each constituted by a frontal face constituting a stop, 9*a*, 9*b*. Stops 9*a*, 9*b* are disposed in a common diametral plane passing through the axis of neck 6; moreover, they are disposed in the plane of symmetry of the bottle 1 passing through the minor axis of its elliptical cross-section. The ends of the two threads 8*a*, 8*b* which are at their terminations and which are therefore diametrically opposed, each comprise a leader 10*a*, 10*b* respectively, that is to say, a short thread section with a progressively increasing cross-section.

Neck 6 also carries two bosses 11*a*, 11*b* in its upper part, each boss 11*a*, 11*b*, being associated with a respective thread 8*a* and 8*b*. In practice, the neck 6 comprises two threads which are staggered from each other by 180° and which are each interrupted in the vicinity of their starts; they each comprise two sections: one of shorter length constituting a boss 11*a*, 11*b* respectively, and the other of greater length which constitutes a thread 8*a*, 8*b* respectively, separated by a zone 12*a*, 12*b* respectively. The shorter length section has a cross-section progressively increasing towards the longer length section and therefore constitutes a thread leader. The adjacent end walls of the two sections of each of the threads are parallel to the axis of neck 6; the end wall of the longer length sections which faces the shorter length section, is therefore disposed in a diametral plane passing through the minor axis of the elliptical cross-section of the bottle.

The stoppering cap is made of a relatively pliable plastic material such as polyethylene and polypropylene. It is constituted by a cylindrical skirt 13 joined to a top 14. Top 14 has a central zone 14*a* which is slightly off-set radially inwardly of the inner cap 2, this central zone 14*a* being joined to the skirt 13 of inner cap 2 via a substantially frustoconical peripheral wall 14*b*.

In the internal wall of skirt 13 is a two start thread system 15*a*, 15*b* intended to cooperate with the two start thread system 8*a*, 8*b* of the neck 6 of bottle 1. The length of the two trapezoidal cross-section threads 15*a*, 15*b* is approximately equal to one turn. The upper ends of threads 15*a*, 15*b* and their respective lower ends are diametrically opposed. The lower and upper ends of threads 15*a*, 15*b* are constituted by thread leaders. Only the upper ends 16*a* and lower ends 17*a* of thread 15*a* have been shown in the drawings, in FIG. 2.

Skirt 13 has, moreover, an internal free chamfered edge 18 intended to facilitate the fitting of inner cap 2 on the neck 6 of bottle 1. Moreover the skirt 13 has, externally, along its free edge, a flange 19 of an external elliptical shape. Flange 19 has a lateral wall 20 defining a peripheral groove 21 whose function will be indicated below. The internal wall of skirt 13 has, near the edge 18, an outwardly directed set back constituting an annular bearing surface 13*a*.

Moreover, the inner cap 2 has two slots 22*a*, 22*b* which are cut in the top of wall 14 and its junction zone with skirt 13. These two slots 22*a*, 22*b* are diametrically opposed. They have such a depth that their bottom walls 23*a*, 23*b* are situated in the upper region of the thread system of inner cap 2. Their width is defined below. Moreover, two central radial planes of these slots 22*a*, 22*b* are disposed substantially in a diametral plane passing through the mirror axis of the elliptical cross-section of flange 19 of inner cap 2, this plane being, moreover, substantially perpendicular to the diametral plane containing the ends of threads 15*a*, 15*b*.

The top of inner cap 2 carries internally, in its central zone 14*a*, a cylindrical skirt 24 intended to penetrate inside the neck 6 of bottle 1 and to cooperate with the wall of the neck 6 to ensure the seal between the neck and the inner cap 2. To facilitate the fitting of inner cap 2 on neck 6, the external edge 25 of inlet 24 is chamfered.

Moreover, the top 14 carries internally an axial stem 26 penetrating into the bottle 1 when the stoppering device is fitted on the same bottle 1. This stem 26 serves to pick up, at its free end, a drop of the pasty substance contained in the bottle and to transport it, for instance, in the hollow of the hand with a view to subsequent application to the skin of the user where the substance is a cosmetic substance which may be used for skin care.

The inner cap 2 is obtained by moulding. To form the slots 22*a*, 22*b* of inner cap 2, the mould comprises slides which are displaced parallel to the axis of inner cap 2 on completion of the moulding. At that time the inner cap 2 is stripped from the mould by unscrewing and not by pulling out which would risk damaging the threads 15*a*, 15*b*.

The presentation cap 3 is made of a harder plastic material, for instance of acrylonitrile-butadiene-styrene (ABS), of a polybutylene terephthalate (PBT), of polypropylene, of a thermosetting resin similar to Bakelite (R.T.M) and sold under the designation of "POLOPAS", or of styrene-acrylonitrile (SAN). It has a skirt 27 of an elliptical cross section, the said skirt 27 being joined to a flat top panel 28. Skirt 27 has, near its free end, a peripheral retaining ring 29 intended to engage in the groove 21 of the flange 19 of inner cap 2.

Moreover, the top panel 28 of the presentation cap 3 carries two protuberances 30*a*, 30*b* which consists of substantially flat fins, perpendicular to the top panel 28, their plane passing substantially through the axis of the presentation cap 3. These fins 30*a*, 30*b* are moreover diametrically opposed. Each fin 30*a*, 30*b* has a substantially constant width except in its portion which is furthest removed from top panel 28 where it progressively decreases. The height of the fins 30*a*, 30*b* is such that in the fitted position of presentation cap 3 on inner cap 2, their lower edges rest on the respective bottoms 23*a*, 23*b* of slots 22*a*, 22*b* and their width is such that in this position, their internal vertical edge should be comprised between the cylindrical surfaces corresponding respectively to the root and to the crest of the thread system of inner cap 2.

Moreover, the length of each of the interrupted zones 12*a*, 12*b*, measured along the centre line of the associated thread of neck 6, is slightly greater than the radial dimension of an associated fin 30*a*, 30*b*.

Fitting of the stoppering device of FIGS. 1 to 4 on the neck 6 is effected in a very simple manner by bringing the presentation cap 3 on to inner cap 2, so that the fins 30*a*, 30*b* are inserted in the respective slots 22*a*, 22*b* of inner cap 2, catch-engagement being obtained by the insertion of the retaining ring 29 in groove 21. In this way, the inner cap 2 and presentation cap 3 are joined once and for all.

The screwing up of the unit constituted by inner cap 2 and presentation cap 3 is effected on one half turn. As the user closes the bottle 1, at the end of the screwing action the fins 30*a*, 30*b* bear against the stops 9*a*, 9*b* which are carried by the neck 6 of bottle 1. In this position, the inner cap 2 cannot be screwed any further around neck 6; it occupies a predetermined angular position and it forms, together with body 4 of bottle 1, an attractive assembly to the extent that the skirt 27 of the presentation cap 3 is the extension of the external lateral wall of the body 4 of bottle 1. In this position, the annular bearing surface 13*a* abuts the upper edge of the peripheral ring 7 of neck 6.

On completion of the screwing action, an elastic deformation of fins 30*a*, 30*b* also occurs so that the fins ride over the bosses 11*a*, 11*b* formed on the neck 6 and come to rest in an interrupted zone, 12*a*, 12*b* respectively.

Figure 3:
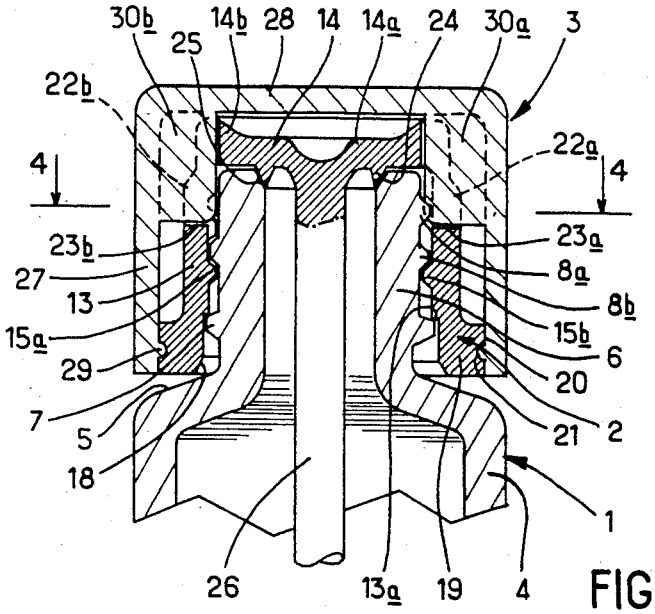
FIG. 3 is a part view of the bottle of FIGS. 1 and 2, angularly orientated in the same way as on FIG. 2 and closed by the stoppering device, the whole being shown in an axial cross-section along line III—III of FIG. 4.
Figure 4:
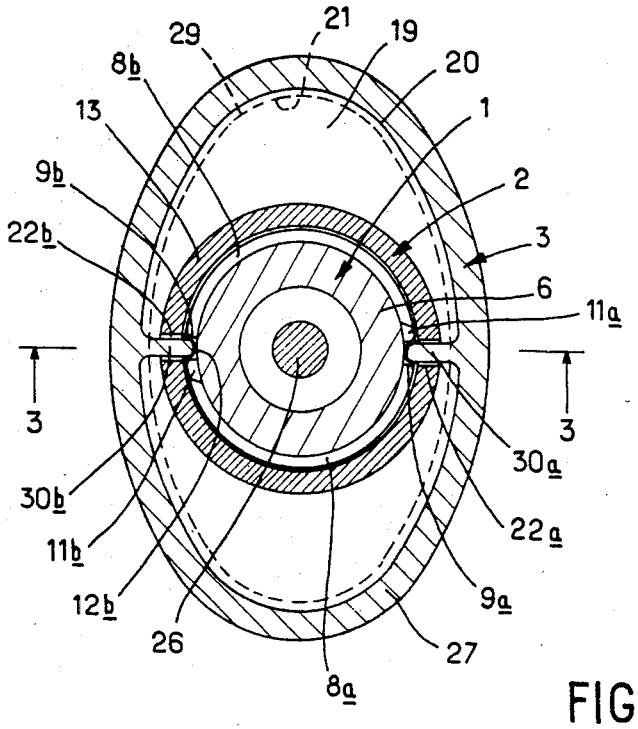
FIG. 4 is a cross-sectional view along line IV—IV of FIG. 3.

FIGS. 3 and 4 illustrate the position wherein fins 30*a*, 30*b* simultaneously abut stops 9*a*, 9*b* and the adjacent walls of the respective bosses 11*a*, 11*b*. This prevents the inner cap 2 from being unscrewed under the effect of impact or vibration. Because bosses 11*a*, 11*b* hold back the inner cap 2, on commencement of the unscrewing action it is necessary for the inner cap 2 to be disengaged from the said bosses 11*a*, 11*b* which constitutes a restraint to be unscrewing motion.

It will, moreover, be found that the angular positioning of the stoppering device in relation to the bottle is ensured by two elements of a hard material abutting each other, these elements being independent of the internal thread system of the pliable cap which allows the cap to ensure a perfect screwing action in the usual way. The choice of a pliable material for the inner cap 2, moreover, allows the seal of bottle 1 to be ensured by the always precise abutment of the top 14 of inner cap 2 and of its inner skirt 24 on the internal edge of the discharge opening of the bottle 1.

Figure 5:
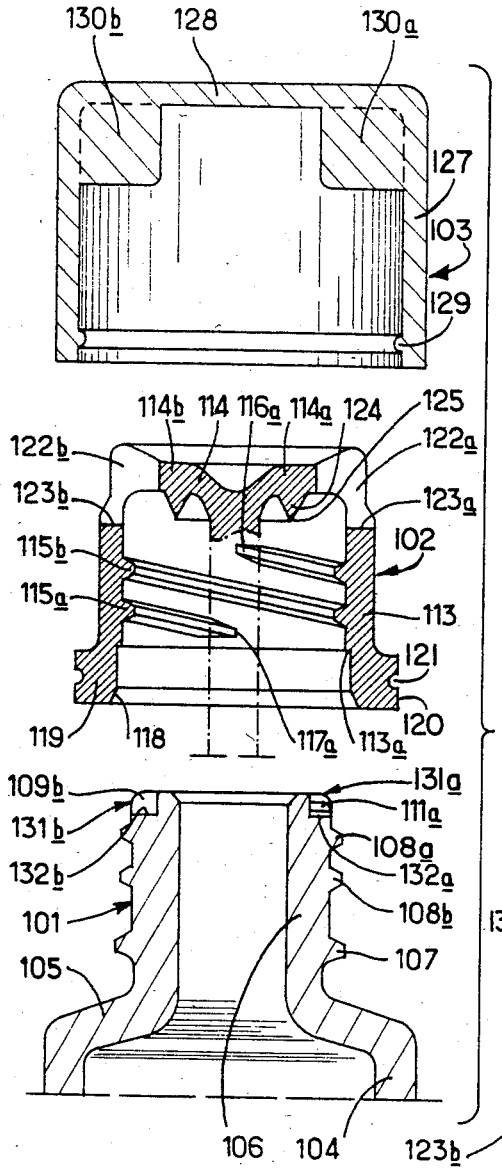
FIG. 5 is a view, similar to FIG. 2, of a bottle and of its stoppering device in accordance with a second embodiment of the invention, subject to the difference that the bottle is represented in an axial cross-section.
Figure 7:
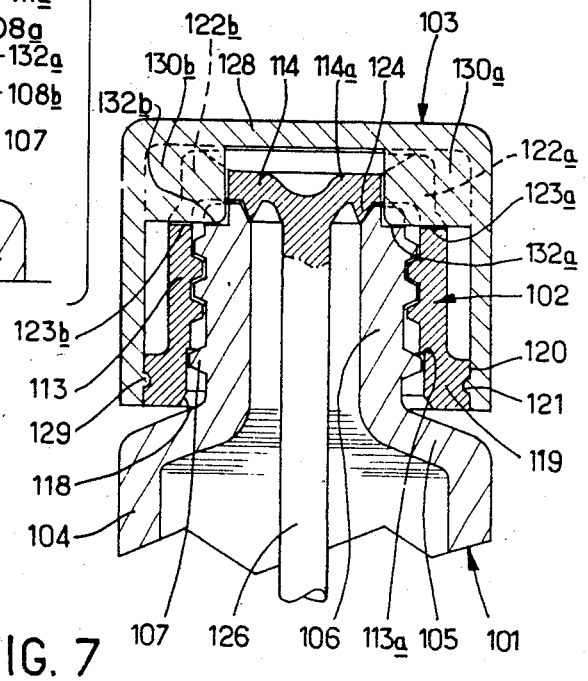
FIG. 7 is a view, similar to FIG. 3, of the bottle of FIGS. 5 and 6, and of the stoppering device associated therewith.

In FIGS. 5 and 7 of the drawings, there has been shown a second embodiment of a bottle 101 in accordance with the invention, its stoppering device being constituted by an inner cap 102 of a pliable material and by a presentation cap 103 of a rigid plastic material. Those elements, of bottle 101, cap 102, and presentation cap 103, which are found to be identical in the device of FIGS. 1 to 4 have been marked in the drawings by reference numbers adding 100 to those used for FIGS. 1 to 4. Below there will only be described the differences between these two embodiments.

Figure 6:
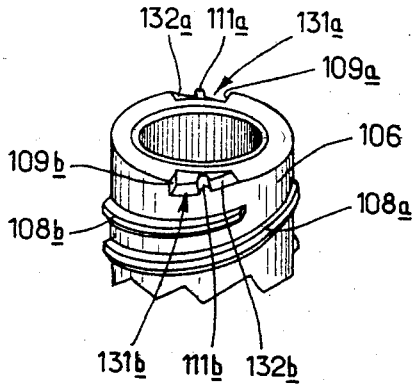
FIG. 6 is a perspective view of the neck of the bottle of FIG. 5.

Bottle 101 has a neck 106 which may be seen in greater detail in FIG. 6. Neck 106 carries externally a two start thread system 108*a*, 108*b* whose diametrically opposed upper ends terminate along thread leaders, like their lower ends. The lateral wall of neck 106 does not comprise any boss.

On the upper edge neck 106, are two diametrically opposed recesses 131*a*, 131*b* each of which comprises a lower face 132*a*, 132*b* in the shape of a helical ramp in the same direction as thread 108*a*, 108*b* and a radial limiting face which constitutes a step forming a stop 109*a*, 109*b*. The two stops 109*a*, 109*b* are disposed in a common diametral plane of the neck 106.

On the lower side 132*a*, 132*b* of each recess 131*a*, 131*b*, is a boss 111*a*, 111*b*. The distance measured radially between one stop 109*a* or 109*b* and the adjacent edge of the respective boss 111*a*, 111*b* which is associated with it, is slightly greater than the radial dimension of a respective fin 130*a*, 130*b*.

The stops 109*a*, 109*b* perform the same function as stops 9*a*, 9*b*, and bosses 111*a*, 111*b* perform the same function as bosses 11*a*, 11*b*. In this embodiment, fins 130*a*, 130*b* have a height lower than that of fins 30*a*, 30*b* since the stops 111*a*, 111*b* are formed on the upper edge of neck 106.

The functioning of the bottle of FIGS. 5 to 7, and of the stoppering device associated therewith, is strictly the same as that of FIGS. 1 to 4. It will, however, be observed that the recesses 131*a* and 131*b* are disposed, relative to the ends of threads 108*a*, 108*b*, at the starts of said threads and are dimensioned in such a way that after one quarter of a turn in the screwing direction, the skirt 124 of top 114 of the presentation cap 106 arrives in the sealing position. It will, moreover, be emphasised that the shape of the helical ramp of the lower faces 132*a*, 132*b* of the recesses 131*a*, 131*b* allows the lower edge of fins 130*a*, 130*b* to be guided at the end of the screwing action or at the start of unscrewing.

Figure 8:
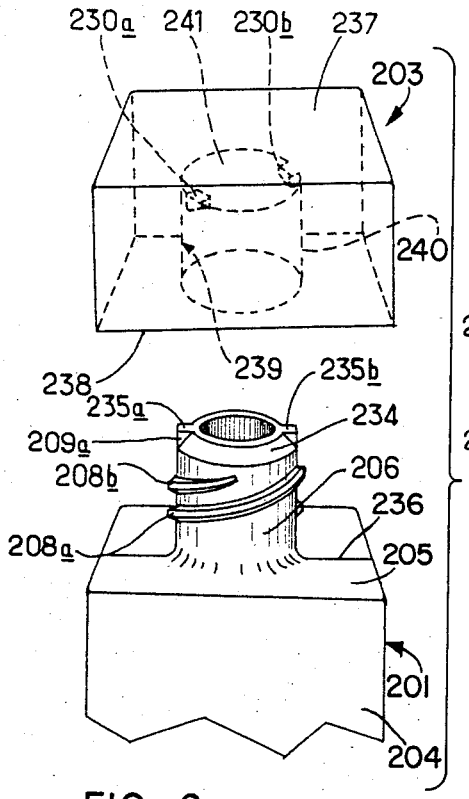
FIG. 8 is an exploded perspective view of the upper part of a bottle with its stoppering device, in accordance with a third embodiment of the invention.
Figure 9:
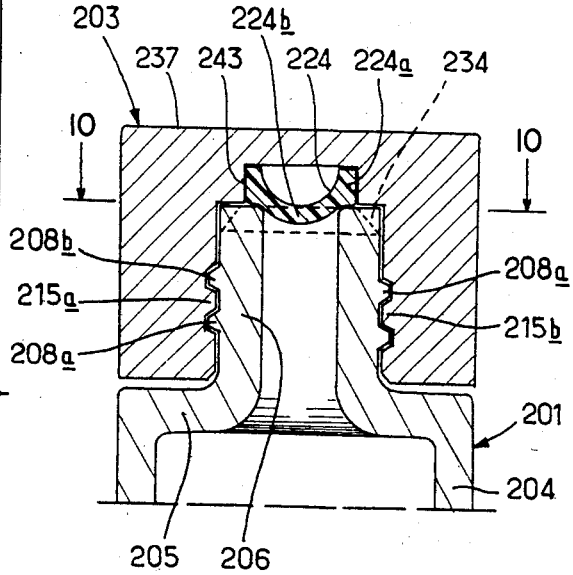
FIG. 9 is a part view, of an axial cross-section on an enlarged scale, of the bottle of FIG. 8 closed by its stoppering device.
Figure 10:
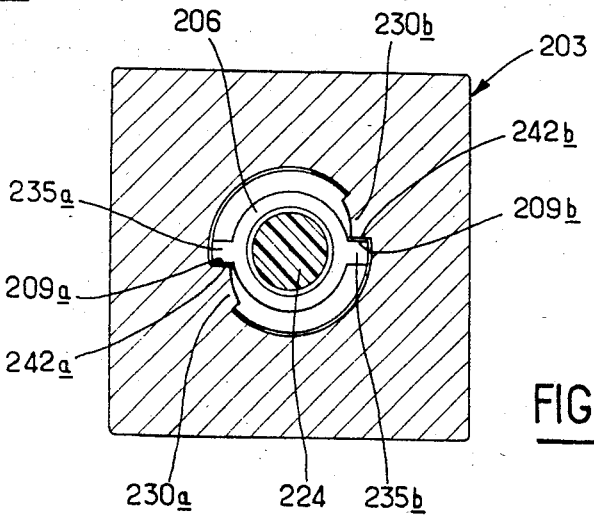
FIG. 10 is a cross-sectional view along line X—X of FIG. 9.

Referring now to FIGS. 8 to 10, there will be seen a glass bottle 201 in accordance with a third embodiment of the invention, wherewith there is associated a stoppering device consisting of a presentation cap 203 made of a relatively rigid plastic material such as polyamide, polybutylene terephalate (PBT) polyacetyl, a thermosetting resin similar to Bakelite and sold under the designation "POLOPAS", cellulose acetate, or acrylonitrilebutadiene styrene (ABS).

Bottle 201 has a body 204 with a substantially square cross section, whose upper face 205 is joined to a central cylindrical neck 206 carrying a two start thread system 208*a*, 208*b* where the diametrically opposed upper ends of the threads terminate along thread leaders in the same way as their lower ends. The lateral wall of neck 206 does not comprise any boss.

The cylindrical wall of neck 206 has a constriction above the thread system 208*a*, 208*b*, the constricted zone 234 of neck 206 extending as far as its edge and having two ribs 235*a*, 235*b* which are diametrically opposed and disposed substantially in a common diametral plane of neck 206, this plane being advantageously the plane of the glass seam of the bottle delimited by line 236, as may be seen in FIG. 8. This disposition of the ribs 235*a*, 235*b* allows gas clearance at the time of manufacture as well as a good removal of the two elements of bottle 201 from their mould.

The external surface of each of ribs 235*a*, 235*b* which is the furthest removed from the constricted zone 234 of the neck 206 does not project beyond the cylindrical wall of neck 206 carrying the thread system 208*a*, 208*b*.

For each of the ribs 235*a*, 235*b*, *a radial wall constitutes a stop* 209*a*, 209*b* respectively whose function is indicated below.

The presentation cap 203 consists of an element having the shape of a right angled parallelepiped whose upper side 237 and lower side 203 are substantially square. In the lower face 238 in a cylindrical cavity 239 coaxial with the vertical axis of symmetry of the presentation cap 203. In the cylindrical wall 240 delimiting this cavity 239 is a two start thread system 215*a*, 215*b* (FIG. 9) intended to cooperate with the two start thread system 208*a*, 208*b* of the neck 206 of bottle 201.

Against the top end 241 of cut out 239 and also against the cylindrical wall 240 are two protuberances 230*a*, 230*b* staggered from each other by 180°. Each protuberance 230*a*, 230*b* has the shape of a thread element with the same pitch as the thread system 215*a*, 215*b* in relief on wall 240 and stopping against the top end 241. This embodiment of the protuberances 230*a*, 230*b* allows the stopper 203 to be removed from the mould by being unscrewed. Each protuberance 230*a*, 230*b* has a radial wall 242*a*, 242*b* intended to bear against a stop 209*a*, 209*b* of the neck.

Moreover, the protuberances 230*a*, 230*b* are disposed in such a way that on completion of screwing, when they come to bear respectively against stops 209*a*, 209*b*, the external lateral walls of the presentation cap 203 should be orientated in the same planes as the respective lateral walls of the bottle 201.

Moreover, in the top end 241 of the cavity 239 is a central cylindrical cutout 243 accommodating a deformable hemispherical gasket 224, made in particular of polyethylene and being force-fitted in this cut-out 243 by its edge wall 224*a*. The dished central portion 224*b* of the gasket ensures the seal of the cap 203 on the neck 206 as may be seen in FIG. 9.

During closing of the bottle, the gasket 224 abuts the neck 206 after one quarter of a screwing turn has been made.

Figure 11:
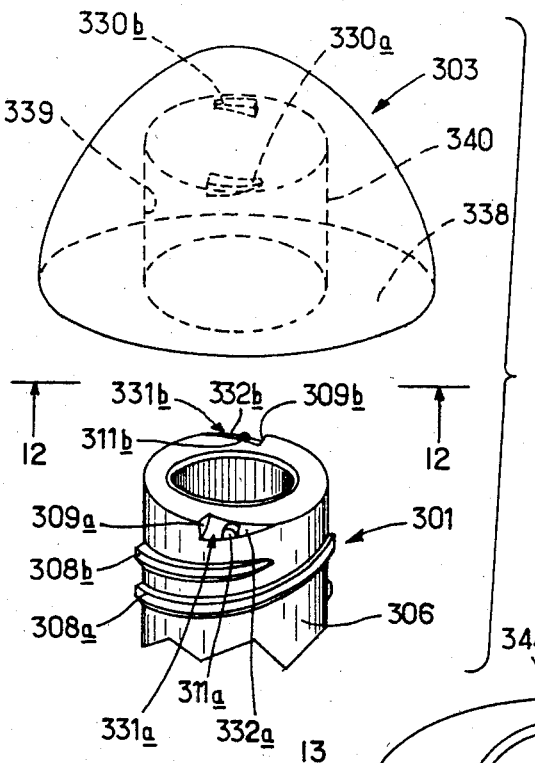
FIG. 11 is an exploded perspective view of the upper part of a bottle with its stoppering device, in accordance with a fourth embodiment of the invention.
Figure 12:
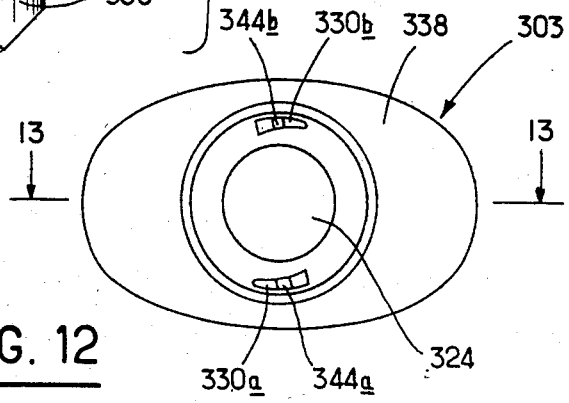
FIG. 12 is a view of the lower part of the stoppering device of the bottle of FIG. 11, taken along line XII—XII of FIG. 11.
Figure 13:
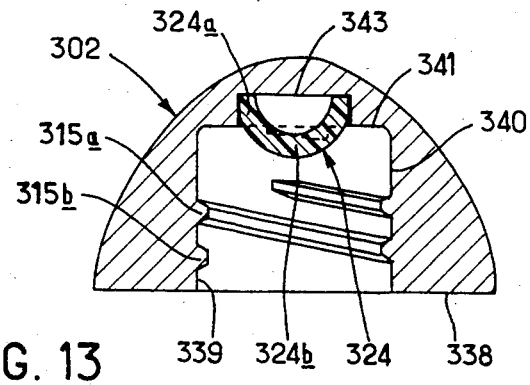
FIG. 13 is an axial cross-sectional view of the stoppering device of the bottle of FIG. 11, taken along line XIII—XIII of FIG. 12.

If reference is now made to FIGS. 11 to 13, there will be seen a bottle 301 of glass or of a rigid plastics material wherewith there is associated a presentation cap 303, in accordance with the fourth embodiment of the invention.

Bottle 301, which may have a square or rectangular cross section, has a neck 306 which carries externally a two start thread system 308*a*, 308*b* having the same characteristics as the threads of the embodiments described above.

On the upper edge of neck 306 are two diametrically opposed recesses 331*a*, 331*b*. Each of these cut-outs 331*a*, 331*b* is obtained by chamfering the upper external edge of neck 306 and comprises a lower face 332*a*, 332*b* in the shape of a helical ramp in the same direction as threads 308*a*, 308*b* and a radial limiting face constituting a step forming a stop 309*a*, 309*b*. The two stops 309*a*, 309*b* are disposed in a common diametral plane of neck 306.

By forming recesses 331*a*, 331*b* by chamfering rather than by cutting in of the upper edge of the neck as is the case in the second embodiment (see FIG. 6), the present invention can be implemented on bottles having necks with a relatively smaller diameter.

The presentation cap 303 has an overall hemiellipsoidal shape. It comprises a lower flat face 338 wherein there is formed a cylindrical cavity 339 delimited by a lateral wall 340 which has a two start thread system 315*a*, 315*b* intended to cooperate with the thread system 308*a*, 308*b* of neck 306.

Against the top end 341 of the cylindrical cavity 339 are diametrically opposed protuberances 330*a*, 330*b*, which are complementary to the recesses 331*a*, 331*b* of neck 306. It will be observed here, too, that the protuberances 330*a*, 330*b*, have a shape such that stopper 303 may, on removal from the mould, be obtained by simple unscrewing to the extent that the shape of the protuberances 330*a*, 330*b* is "indexed" on the pitch of threads 315*a*, 315*b*.

Bosses 330*a* and 330*b* and the recesses 331*a*, 331*b* are disposed in relation to the respective thread system of neck 306 and of presentation cap 303 in such a way that on completion of screwing, the bosses 330*a*, 330*b* are accommodated exactly in the recesses 331*a*, 330*b* provided for this purpose. Moreover, in this position the presentation cap 303 should be orientated in relation to bottle 301 in such a way that the axial plane of the presentation cap 303 passing through the major axis of its ellipsoidal wall 338 should coincide with an axial plane of symmetry of bottle 301 if the bottle has a square cross-section, or with the axial plane of symmetry of bottle 301 parallel with its longer lateral surfaces if the cross-section of the bottle 301 is rectangular.

As in the first and second embodiments, pilfer-proofing means may be provided for preventing the untimely unscrewing of the bottle. These pilfer-proofing means may consist of bosses 311*a*, 311*b* (FIG. 11) disposed respectively against the walls 332*a*, 332*b* of recesses 331*a*, 331*b*, the said bosses 311*a*, 311*b* being accommodated in the recesses 344*a*, 344*b* (FIG. 12) in the protuberances 330*a*, 330*b* respectively, on completion of the screwing action. Such a disposition could be envisaged for the third embodiment.

Sealing in this fourth embodiment is effected in the same way as in the third embodiment, by means of a hemi-spherical gasket 324 which penetrates into a cut-out 343 formed in wall 341 of the presentation cap 301. The reference numbers relating to this gasket have 100 added to those used for FIG. 9.

The gasket 324 for ensuring sealing and taking up play is disposed in such a way that its leakproof engagement with the neck 306 is ensured after one quarter turn in the screwing direction.

Figure 15:
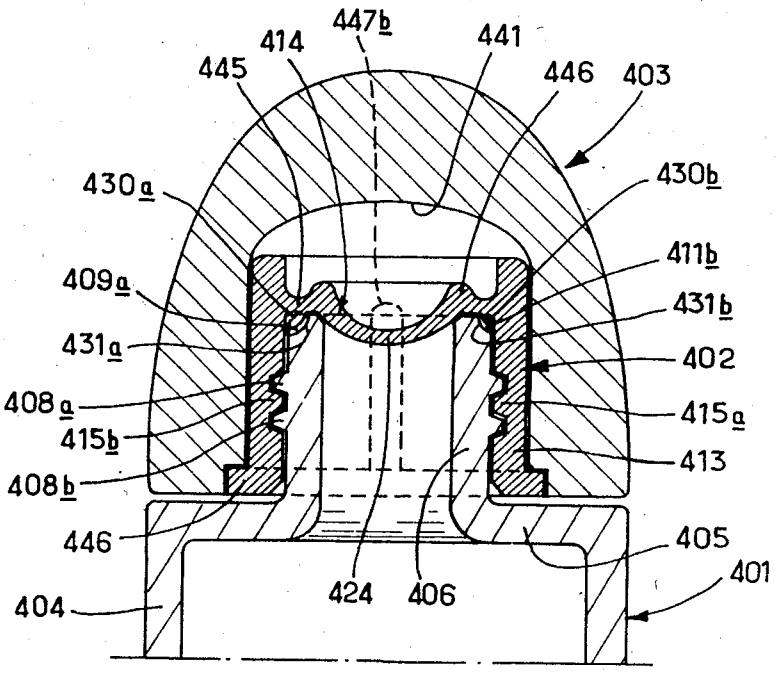
FIG. 15 is a part axial cross-sectional view, on an enlarged scale, of the bottle of FIG. 14 closed by its stoppering device.
Figure 14:
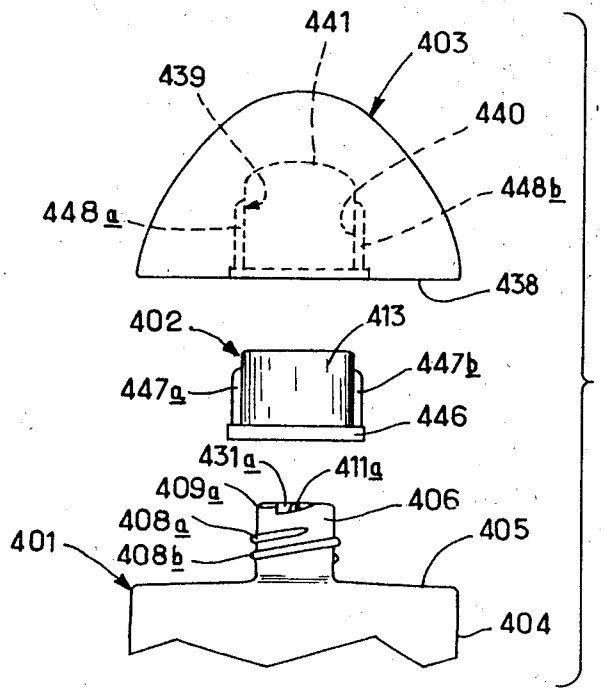
FIG. 14 is an exploded perspective view of the upper part of a bottle with its stoppering device, in accordance with a fifth embodiment of the invention.

FIGS. 14 and 15 show a fifth embodiment of the bottle and its stoppering device in accordance with the present invention.

FIG. 14, showing a bottle 401, which is of the same type as bottle 301, carries reference numbers having 100 added to those used for the bottle 301.

The stoppering device of this bottle 401 comprises an inner stoppering cap 402 made of relatively pliable plastics material and a presentation cap 403 made of a hard plastics material.

The stoppering cap 402 is constituted by a cylindrical skirt 413 joined to a top 414 which has, on the whole, a lesser thickness than skirt 413. Top 414 has a central dished zone with its concavity turned towards the free edge of skirt 413, this central zone being joined to a peripheral zone 445 by an external peripheral bead 446. The central zone constitutes a sealing zone 424, the peripheral bead 446 coming into the stoppering position against the internal edge of neck 406 to ensure with the sealing zone 424 a perfect seal.

In the internal wall of skirt 413, there is a two start thread system 415*a*, 415*b* intended to cooperate with the two start thread system 408*a*, 408*b* of neck 406. Moreover, cap 402 internally comprises, against the top end 414 and against skirt 413, two protuberances 430*a*, 430*b* of the same type as the protuberances 330*a*, 330*b* intended to abut against stops 409*a*, 409*b* of neck 406, after passing bosses 411*a*, 411*b* on completion of the screwing action.

Moreover, the skirt 413 has, along its free edge, an external bead 446 and it carries externally two opposed ribs 447*a*, 447*b* which end on the bead 446 and are disposed in one and the same radial plane of the cap.

Presentation cap 403 has the same overall shape as that of the embodiment described above. In its lower face 438 is a cavity 439 delimited by a cylindrical wall 440 joined to a slightly domed top 441. Wall 440 comprises two grooves 448*a*, 448*b* situated in the axial plane of the presentation cap 403 passing through the major axis of face 438. The grooves extend from this face 438 as far as the vicinity of the top 441.

The inner cap 402 and presentation cap 403 are formed by moulding. The protuberances 430*a*, 430*b* of the inner cap 402 are constituted by thread elements with the same pitch as threads 415*a*, 415*b* and stripping the inner cap 402 from the mould is effected simply by unscrewing, and not by pulling out which risk damaging threads 415*a*, 415*b*.

The mounting of this stoppering device is achieved very simply by placing the presentation cap 403 on to the cap 402 so that the ribs 447*a*, 447*b* are force-fitted in the grooves 448*a*, 448*b* of the presentation cap 403. In this way the inner cap 402 and presentation cap 403 are substantially permanently fitted together. As the user closes the bottle 401, the protuberances 430*a*, 430*b* abut the radial walls 409*a*, 409*b* of the neck 406 on completion of the screwing action. In this position, the stoppering device cannot be screwed down any further on the neck 406, and it occupies a predetermined angular position so that the presentation cap 403 should be disposed in an attractive way in relation to the body 404 of bottle 401.

Figure 16:
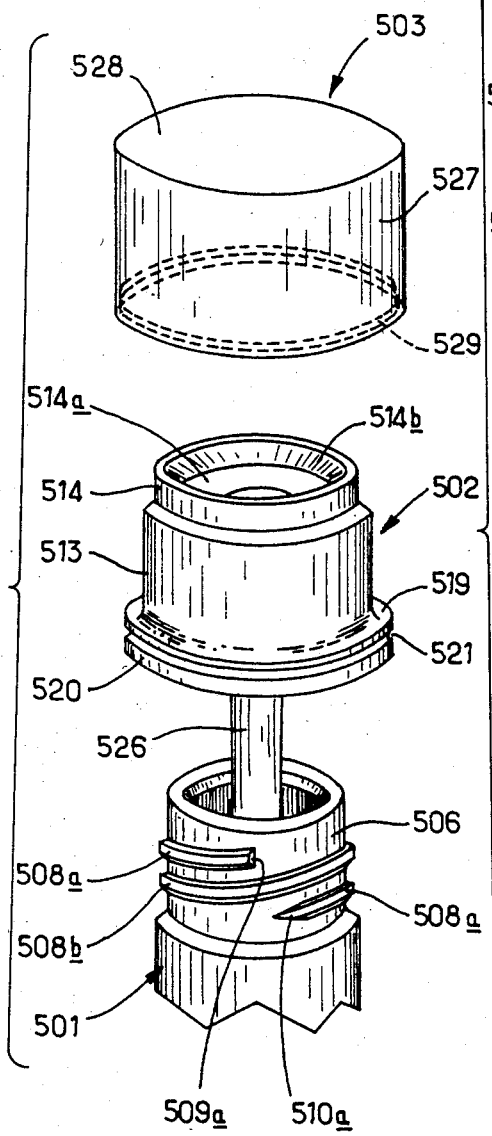
FIGS. 16 and 17 are views similar respectively to FIGS. 1 and 2 and in accordance with a sixth embodiment of the invention.
Figure 17:
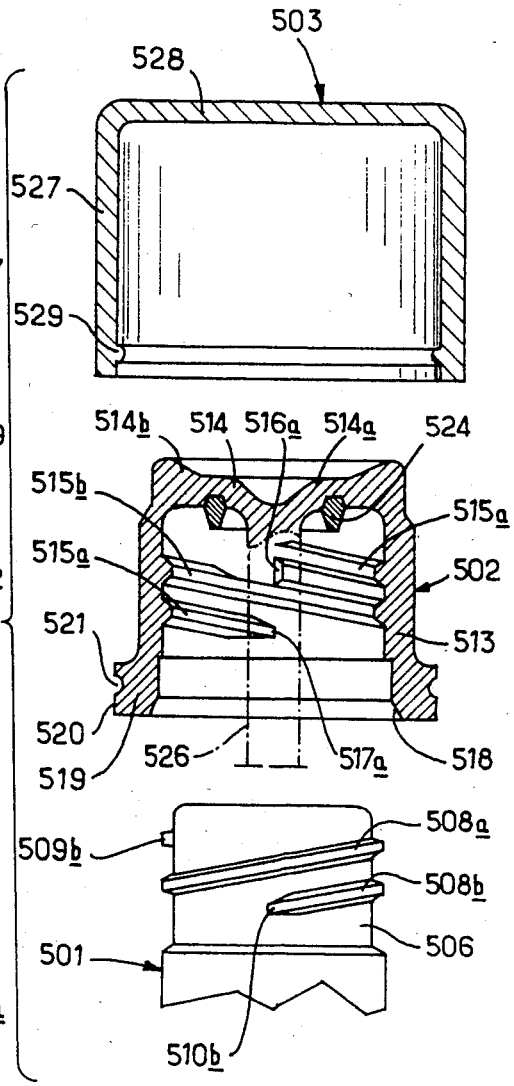

FIGS. 16 and 17 show another embodiment of a bottle and of its stoppering device in accordance with the invention, this embodiment having any characteristics in common with the embodiment described with reference to FIGS. 1 to 4. For this reason, the elements of FIGS. 1 and 2 which are also found on FIGS. 16 and 17 are marked by reference numbers having 500 added to those used in FIGS. 1 to 4. The bottle 501 of glass of PVC has a small capacity and is intended to contain, for instance, a cosmetic substance with a pasty consistency. The bottle 501 is associated with a stoppering device composed of an inner cap 502 and an outer presentation cap 503, and has a cylindrical neck 506 which carries externally a two start thread system 508*a*, 508*b* with threads of substantially trapezoidal cross-section which are staggered from each other by 180°. Each thread 508*a*, 508*b* has a length substantially equal to three quarters of one turn, and the starting ends of the respective threads 508*a*, 508*b* are each constituted by a frontal, radial face constituting a stop 509*a* and 509*b* respectively. These two stop faces 509*a*, 508*b* are disposed in a common diametral plane passing through the axis of the neck 506 as well as in a particular plane of the bottle 501. For instance, if this bottle has a body with a substantially elliptical cross section, this directional plane is the plane of symmetry which passes through the minor axis of its elliptical cross-section The terminating ends 510*a*, 510*b* of the two threads 508*a* and 508*b* are also diametrically opposed and have the shape of a thread leader, with a progressively increasing cross-section.

The inner stoppering cap 502, moulded in a relatively rigid plastic material, is constituted by a cylindrical skirt 513 joined to a top 514 which has a central zone 514*a* slightly offset radially inwardly of the cap 502 and joined to skirt 513 by a peripheral, substantially frustoconical wall 514*b*. In the internal wall of skirt 513, is a two start thread system 515*a* and 515*b*, intended to come to cooperate with two start thread system 508*a* and 508*b* of the neck 506 of bottle 501. The length of the two trapezoidal cross-section threads 515*a* and 515*b* is approximately equal to one turn. The upper ends and lower ends, respectively, of threads 515*a* and 515*b* are diametrically opposed and whilst the lower ends of these threads each delimit with an adjacent portion of the other thread 515*b* or 515*a* an inlet opening of an accommodating groove for a corresponding thread 508*a*, 508*b* of neck 506, and are constituted by thread leaders such as 517*a*, the upper ends are each joined to a radial wall 516*a* contained in an axial plane and which is joined to the adjacent lower position of the other thread 515*b* or 151*a*, so that this radial wall constitutes a frontal end wall which radially closes an accommodation groove for one thread 508*a* or 508*b* of neck 506.

Moreover, the skirt 513 has internally a free chamfered lower edge 518 facilitating the positioning of the inner cap 502 on neck 506, and externally a flange 519 whose external shape corresponds in horizontal cross-section to the shape of the body of bottle 501, for instance an elliptical one. This flange 519 has a lateral wall 520 wherein there is cut a peripheral groove 521 whose function is indicated below.

Finally, the top 514 of inner cap 502 carries internally, the one hand, an axial stem 526 intended to enter the bottle 501 when the stoppering device is mounted thereon and serving to pick up, at its free end, a drop of the pasty contents of bottle 501 and, on the other hand, an attache annular gasket 524 surrounding the stem 526 and anchored in a groove on the internal face of the central zone 514*a* of the top 514. This pliable and deformable gasket 524 is made of a cellular material or of polyethylene. The innner cap 502 is moulded and is stripped from the mould by unscrewing the internal core used for the moulding of the cap, without damaging the threads 515*a* and 515*b*.

The presentation cap 503 is made of a hard plastics material, for instance of ABS, PBT, SAN, or polypropylene, and has a skirt 527, for example of an elliptical cross-section, joined to a flat top 528. Near its free edge, the skirt 527 has an internal and peripheral retaining ring 529 intended to be fitted by catch-engagement in the groove 521 of the flange 519 of inner cap 502.

The mounting of the stoppering device of FIGS. 16 and 17 is effected in a very simple way by placing the presentation cap 503 on the inner cap 502 so that the catch-engagement may be obtained by insertion of the retaining ring 529 in the groove 521: thus the inner cap 502 and presentation cap 503 are fitted together once and for all.

Screwing down the assembly constituted by the inner cap 502 and presentation cap 503 on the neck 506 is effected over one half turn. When the user closes the bottle 501, the radial front faces such as 516*a* which form the ends of the grooves delimited between threads 515*a* and 515*b* of the inner cap 502 abut the radial frontal faces 509*a* and 509*b* at the start of threads 508*a* and 508*b* of neck 506.

The inner cap 502 cannot be screwed down any further on the neck 506 and now occupies a predetermined angular position. If, as has been shown in FIGS. 16 and 17, the radial end faces of the grooves of the internal thread system of inner cap 502 are in a common plane parallel to the major axis of the elliptical cross-section of flange 519 of inner cap 502, while the two stop faces 509*a* and 509*b* of neck 506 are in a common plane parallel to the minor axis of the elliptical cross-section of the bottle 501, the stoppering device will, on completion of the screwing action, be in a "crossed" position in relation to the position of bottle 501 which will give a special aesthetic effect. On the other hand, if the two stop faces 509*a* and 509*b* of the neck 506 and the two faces of the ends of the grooves of the internal thread system of inner cap 502 are in respective common planes parallel to the minor axis of the elliptical cross-section of the bottle 501 and of the flange 519 of inner cap 502, respectively, the stoppering device forms one aesthetic whole with the bottle 501, such that the skirt 527 of the presentation cap 503 should be an extension of the external lateral wall of the body of the bottle 501.

Such a device allows the advantages of the embodiments of FIGS. 1 to 15 to be retained, without having their drawbacks as regards the complexity of the structure, because the stops of the neck are in its upper portion which simplifies its manufacture and since a precise annular positioning is obtained by bringing two elements of a rigid or relatively rigid material into abutment. The sealing and the play necessary for the positioning of the cap are ensured by the pliable and deformable annular gasket 524 which may be force-fitted in any convenient way into the bottom of the cut out of the inner cap, or of the presentation cap if the stoppering device does not comprise any inner cap (the internal thread then being carried by the presentation cap), there being a projecting part of the gasket so as to ensure the proper seal on the neck.

It shall be duly understood that the modes of embodiment described above are in no way restrictive and may give rise to any desirable modifications without thereby departing from the scope of the invention.

I claim:

1. In a bottle comprising:

(a) a neck;

(b) external thread means on said neck;

(c) a detachable stoppering device;

(d) internal thread means on said stoppering device cooperable with said external thread means of the neck of the bottle;

(e) means effective to ensure the angular positioning of the stoppering device in relation to the bottle, the latter means comprising (i) stop means carried externally in the neck, above the thread means thereof, and (ii) protuberance means carried internally by the stoppering device, said protuberance means being positioned and dimensioned so that when the stoppering device has been completely screwed down the protuberance means abuts said stop means of the neck, wherein said stoppering device is constituted by a stoppering cap and by a presentation cap fitted on the stoppering cap and at least partly covering it, the said stoppering cap being constituted by a cylindrical skirt joined to the top of said stoppering cap, said skirt carrying said internal thread means cooperating with the corresponding external thread means of the neck;

the improvement wherein said protuberance means is carried by the presentation cap and is in the form of a fin which is engaged in a slot in the wall of said cylindrical skirt near the periphery of said top thereof.

2. A bottle according to claim 1 wherein said presentation cap is constituted by a lateral wall joined to a top panel, two fins being provided and said fins are substantially flat and perpendicular to said top panel of the presentation cap, and said fins are in a plane which passes substantially through the axis of said presentation cap.

3. A bottle according to claim 1, wherein the stop means of the neck against which said protuberance means abuts on completion of the screwing action is constituted by a step formed on the upper edge of said neck and means defining a recess of said neck shaped so as to allow said protuberance means to be guided in said recess completion of the screwing action until said protuberance means abuts said step, said 4. A bottle according to claim 3, wherein said recess on the upper edge of the neck comprises a lower face in the shape of a helical ramp having the same pitch as the external thread means carried by said neck.

5. A bottle according to claim 3, including means for preventing loosening of the screwed down stoppering device, these latter means comprising at least one boss carried externally by the neck of the bottle and intended to be crossed by said protuberance means of completion of the screwing action before the protuberance means abuts said stop means of the neck, and wherein said at least one boss is carried by the upper edge of the neck and is disposed on the lower side of a said recess.

6. A bottle according to claim 1, including means for sealing the stoppering device to the neck.

* * * * *